US011852315B2

(12) United States Patent
Dixit et al.

(10) Patent No.: US 11,852,315 B2
(45) Date of Patent: Dec. 26, 2023

(54) RECESSED LAMP WITH SEALED ENCLOSURE

(71) Applicant: Appleton Grp LLC, Rosemont, IL (US)

(72) Inventors: Prashant S. Dixit, Pune (IN); Ritu Raj, Muzaffarpur (IN); Rahul Bhamare, Nashik (IN)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 17/748,621

(22) Filed: May 19, 2022

(65) Prior Publication Data

US 2023/0228391 A1 Jul. 20, 2023

(30) Foreign Application Priority Data

Jan. 20, 2022 (IN) ..... 202221003346

(51) Int. Cl.
*F21S 8/02* (2006.01)
*F21V 31/00* (2006.01)

(52) U.S. Cl.
CPC ..... *F21S 8/026* (2013.01); *F21V 31/005* (2013.01)

(58) Field of Classification Search
CPC ..... F21S 8/024; F21S 8/022; F21V 15/01; F21V 31/005
See application file for complete search history.

(56) References Cited

U.S. PATENT DOCUMENTS

| | | | | |
|---|---|---|---|---|
| 2,791,681 | A * | 5/1957 | Dunker et al. | F21S 8/02 292/60 |
| 2,961,530 | A * | 11/1960 | Stahlhut et al. | F21S 8/02 362/311.03 |
| 3,358,138 | A * | 12/1967 | Trantina | F21S 8/02 362/355 |
| 3,810,085 | A * | 5/1974 | Woloski | F21S 8/02 362/277 |
| 4,907,361 | A * | 3/1990 | Villard | G09F 19/228 362/153.1 |
| 7,766,503 | B2 * | 8/2010 | Heiking | F21S 8/026 362/147 |
| 8,783,916 | B2 * | 7/2014 | Tyson | F21S 8/022 362/147 |
| 9,897,288 | B2 * | 2/2018 | Sorensen | E04B 9/366 |
| 9,897,305 | B2 * | 2/2018 | Ryder | F21V 31/005 |
| 10,920,975 | B2 * | 2/2021 | Lax | F21V 31/005 |
| 11,530,787 | B2 * | 12/2022 | Pu | F21S 8/026 |
| 11,572,985 | B2 * | 2/2023 | Wen | F21S 8/026 |
| 2013/0027916 | A1 * | 1/2013 | Caferro | F21S 8/026 362/147 |

* cited by examiner

*Primary Examiner* — Ismael Negron
(74) *Attorney, Agent, or Firm* — McDonnell Boehnen Hulbert & Berghoff LLP

(57) ABSTRACT

A lamp includes a light source, a housing having a mounting fixture fitting the light source, a lid frame defining an opening, a first gasket provided in a first groove formed in the lid frame, a transparent body nested with the first gasket and reflecting light emitted by the light source to be outputted through the opening, retainer clips provided along longitudinal edges of the first groove to compress and seal the first gasket to prevent ingress of dust and moisture through the opening, and three fasteners to securely attach the lid frame to the housing. The housing is configured to be installed recessed of a supporting surface.

22 Claims, 6 Drawing Sheets

RECESSED LAMP WITH SEALED ENCLOSURE

FIELD

This application claims priority to Indian Application No. 202221003346 entitled "A Recessed Enclosure For A Light Source" filed on Jan. 20, 2022, the contents of which are hereby incorporated by reference in their entirety.

The present disclosure relates to the field of enclosures for light sources.

DEFINITION

IP66: The term "IP66" in the description refers to Ingress Protection which is a set of codes and rules dictated for enclosures and casings for rating the degree of protection required against dust, water, intrusion, and accidental contact.

BACKGROUND

The background information herein below relates to the present disclosure but is not necessarily prior art.

Enclosures for a recessed light source usually consist of a housing in which the luminaire is installed and a glass lid attached to the housing to emit the light. Conventionally, the lid is attached hingably to an edge of the housing. The hingeable attachment of the lid creates a gap between the lid and the housing. When such a luminaire enclosure is set up in an IP66 environment, the chances of dust and moisture entering the enclosure through the holes significantly increases. Over a due period of time, accumulation of dust and moisture inside the enclosure damages the light source. Further, in unfortunate situations, if the light source is installed in hazardous gas areas, the toxic gases after coming in contact with the heated light source tend to explode. Moreover, chances of water trickling into the housing increases significantly.

Additionally, at least four holes were punctured on the glass lid and the housing to enable fastening of screws thereon, which conversely added to the stress acting on the area surrounding the holes on the lid. If the stress on these areas increases, the glass becomes more prone to breakage.

There is therefore felt a need for an enclosure for the light source which alleviates the aforementioned drawbacks.

OBJECTS

Some of the objects of the present disclosure, which at least one embodiment herein satisfies, are as follows:

An object of the present disclosure is to provide a recessed enclosure for a light source.

Another object of the present disclosure is to provide a recessed enclosure for a light source which is used in an IP66 environment by protecting the light source from dust and moisture ingress.

Yet another object of the present disclosure is to provide a recessed enclosure for a light source which ensures safety in operation of the light source with ease in installation.

Other objects and advantages of the present disclosure will be more apparent from the following description, which is not intended to limit the scope of the present disclosure.

SUMMARY

The present disclosure envisages a recessed enclosure for a light source.

The recessed enclosure comprises a housing, a light source removably fitted on the mounting fixture, a lid frame, and three fasteners for securely attaching the lid frame to the housing.

The housing is defined by a body having a floor and side walls extending in an operative upward direction from the floor. The housing includes a mounting fixture formed on the floor. The lid frame is defined by a metal body having an operative inner surface, an operative outer surface, and an opening configured on an operative centre of the body for facilitating emission of light from the light source. The lid frame comprises a first groove configured on the operative inner surface, along the periphery of the opening. A first gasket is configured to be housed in the first groove. The first gasket has a crevice configured along the length of the first gasket. A transparent body is nested in the crevice for reflecting light, emitted by the light source, through the opening. A pair of retainer clips is provided along the longitudinal edges of the first groove. The retainer clips are configured to compress and seal the first gasket in the first groove to ensure prevention of ingress of dust and moisture inside the enclosure through the opening.

BRIEF DESCRIPTION OF THE ACCOMPANYING DRAWINGS

A recessed enclosure, of the present disclosure, for a light source will now be described with the help of the accompanying drawings, in which.

LIST OF REFERENCE NUMERALS

Figure 1:
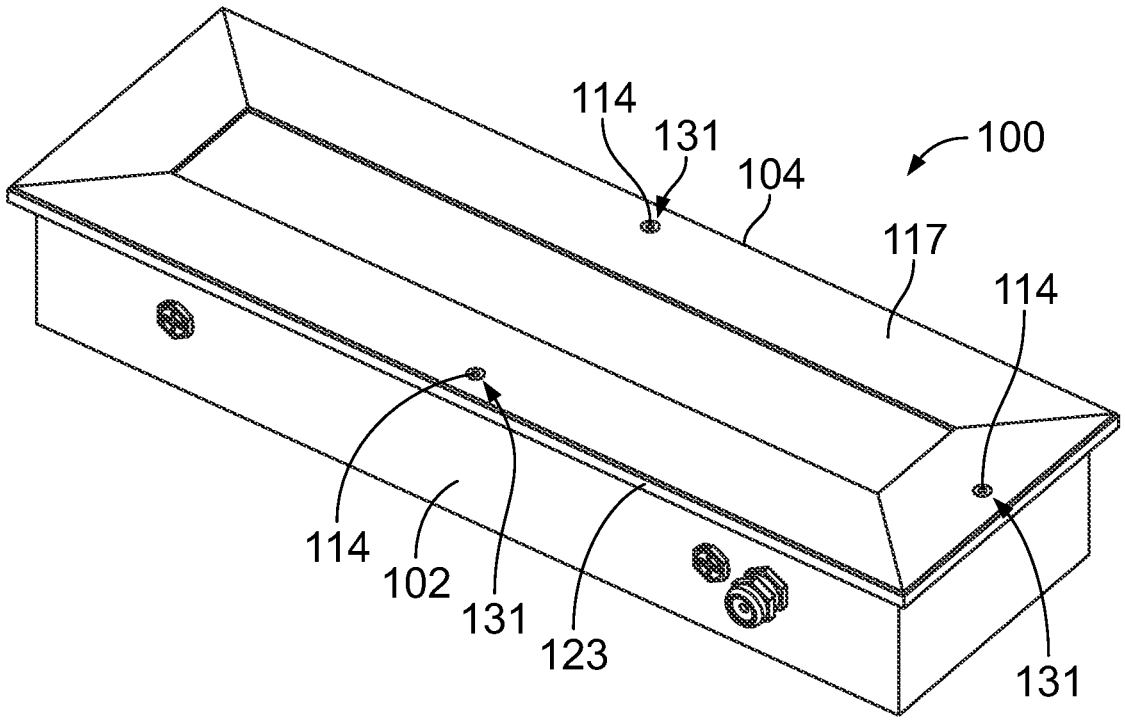
FIG. 1 illustrates an isometric view of the enclosure of the present disclosure.

01 light source
100 enclosure
102 housing
103 floor of the housing
104 lid frame
105 first groove
106 opening in the lid frame
108 first gasket
108*a* flange of the gasket
108*b* walls of the gasket
110 transparent body
111 side walls of the housing
112 retainer clip

113 flap
114 fastener
115 inner surface of the lid frame
116 headboard
117 outer surface of the lid frame
118 lip
119 crevice in the first gasket
120 pressure switch
121 rims in the housing
123 rims in the lid frame
125 indicator
127 second gasket
128 second groove
129 plurality of first apertures in the housing
131 plurality of second apertures in the lid frame
139 plurality of niches
α angle of opening between the lid cover and the housing

DETAILED DESCRIPTION

Embodiments, of the present disclosure, will now be described with reference to the accompanying drawings.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a", "an" and "the" may be intended to include the plural forms as well, unless the context clearly suggests otherwise. The terms "comprises", "comprising", "including" and "having" are open ended transitional phrases and therefore specify the presence of stated features, elements, modules, units and/or components, but do not forbid the presence or addition of one or more other features, elements, components, and/or groups thereof.

Figure 2:
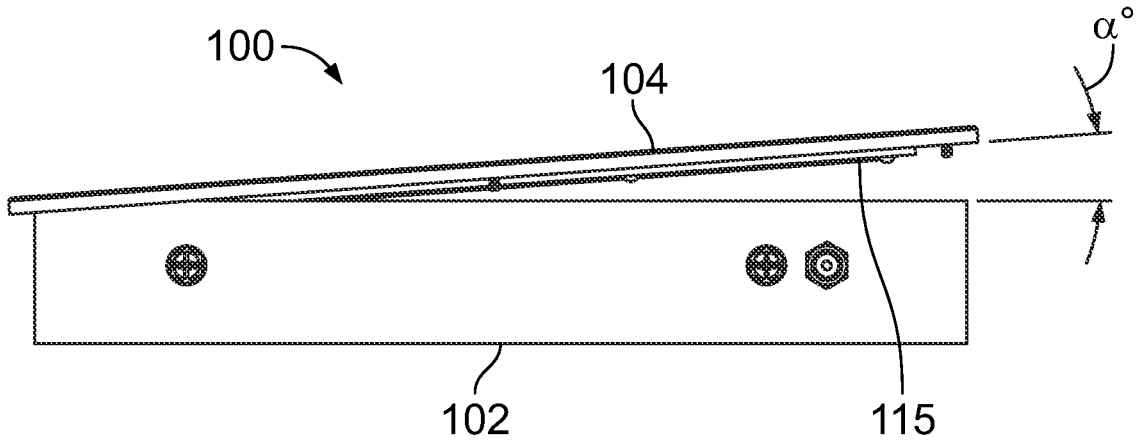
FIG. 2 illustrates a side view of the lid frame hingably mounted on the housing of FIG. 1.
Figure 3A:
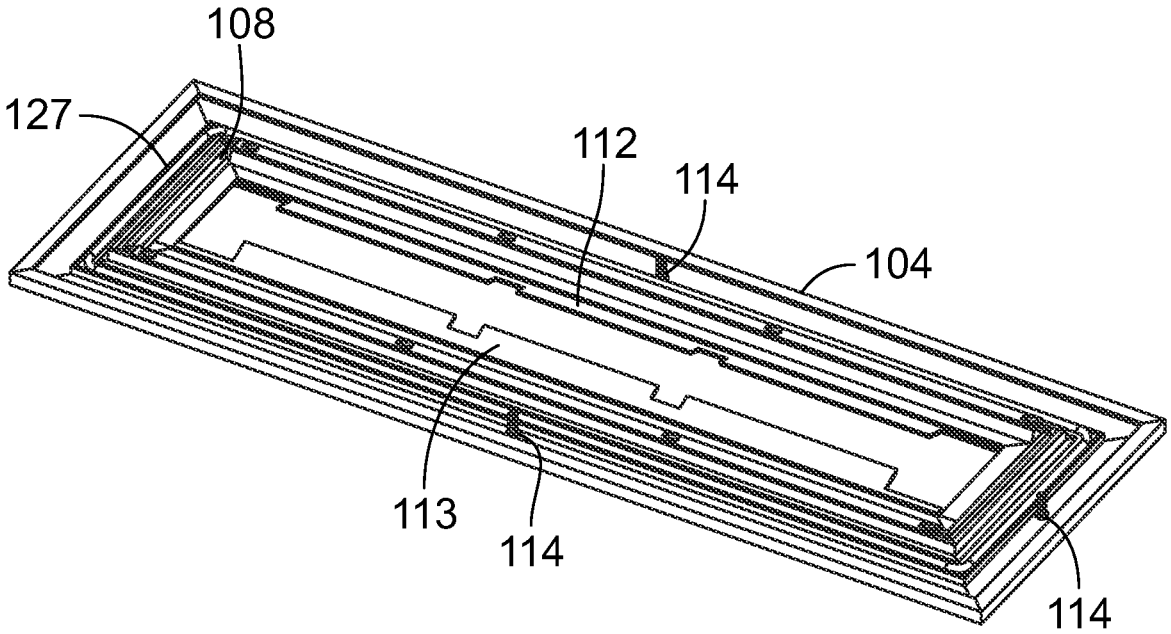
FIG. 3A illustrates an isometric view of a lid frame of the enclosure of FIG. 1 with gaskets installed thereon.
Figure 3B:
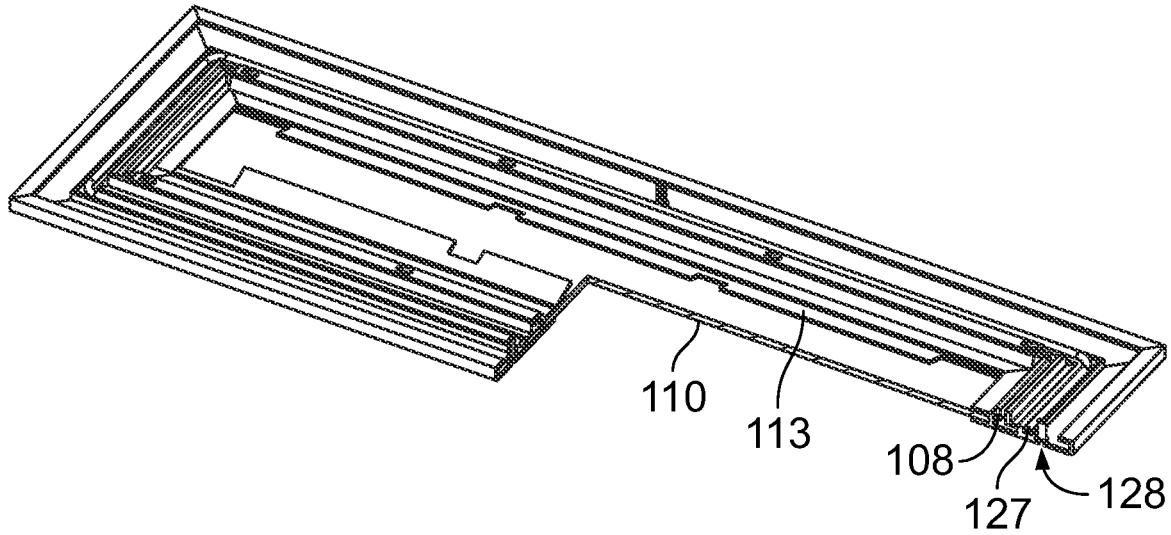
FIG. 3B illustrates an isometric cut-cross sectional view of the lid frame of FIG. 3A.
Figure 4A:
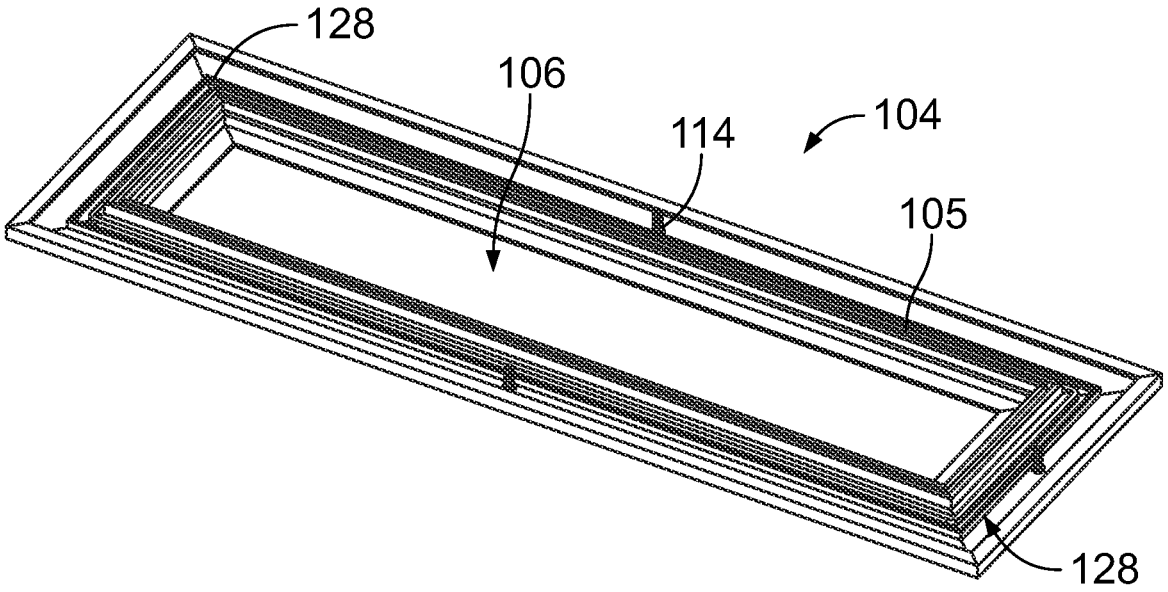
FIG. 4A illustrates an isometric view of the lid frame of FIG. 1 without the gaskets installed thereon.
Figure 4B:
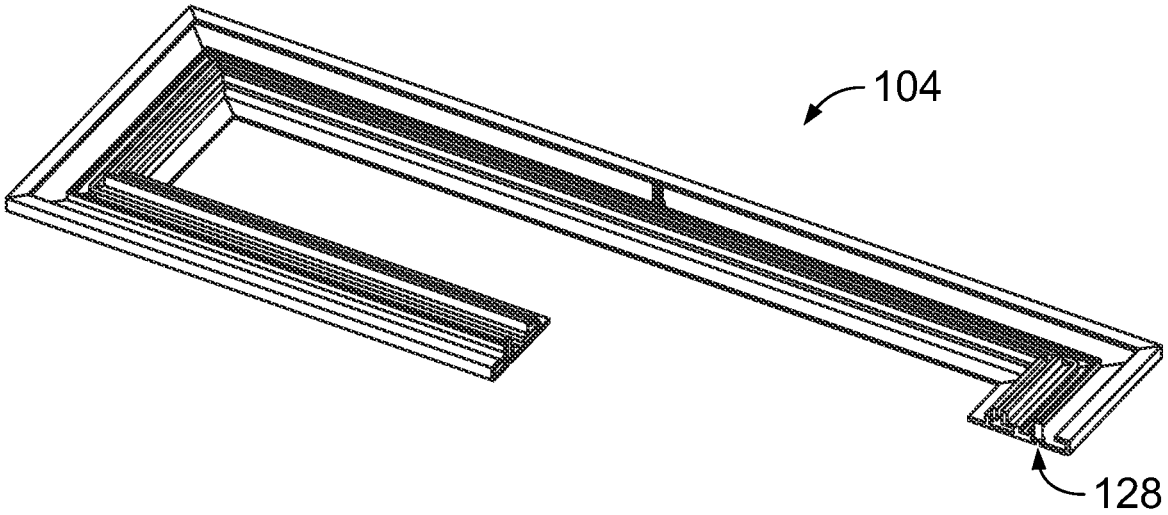
FIG. 4B illustrates an isometric cut-cross sectional view of the lid frame of FIG. 4A.
Figure 5A:
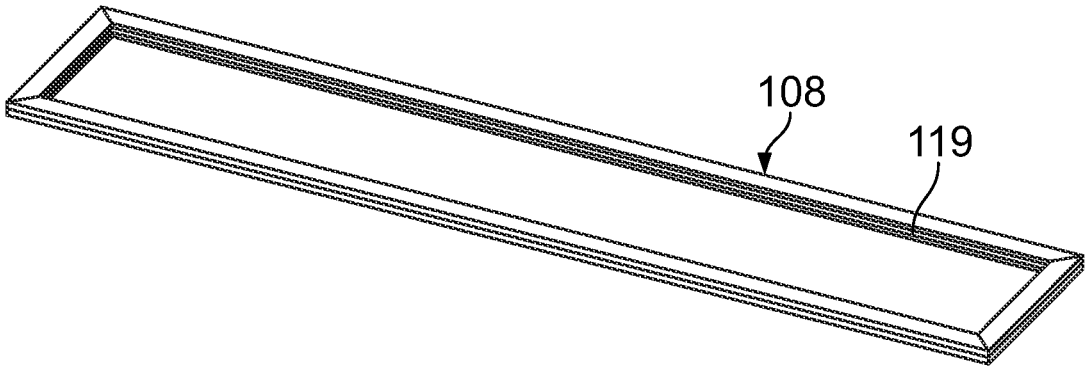
FIG. 5A illustrates an isometric view of the first gasket of FIG. 3A.
Figure 5B:
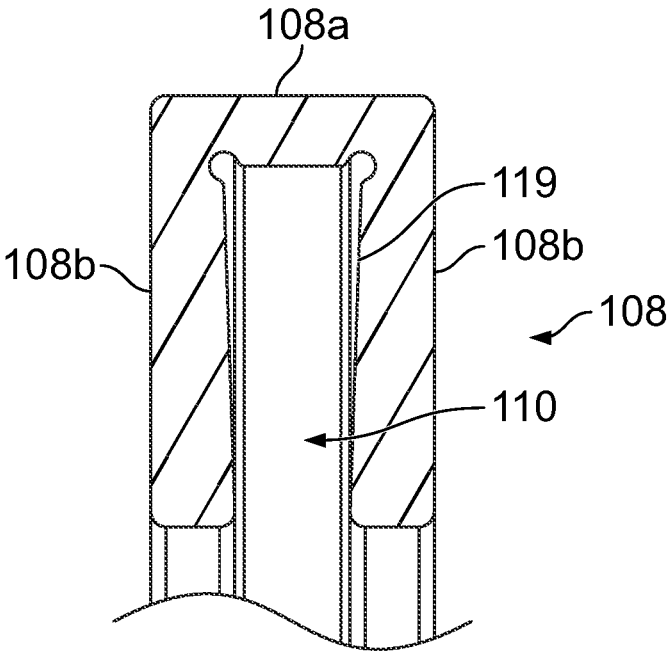
FIG. 5B illustrates a cross-sectional view of the first gasket of FIG. 5A.
Figure 6:
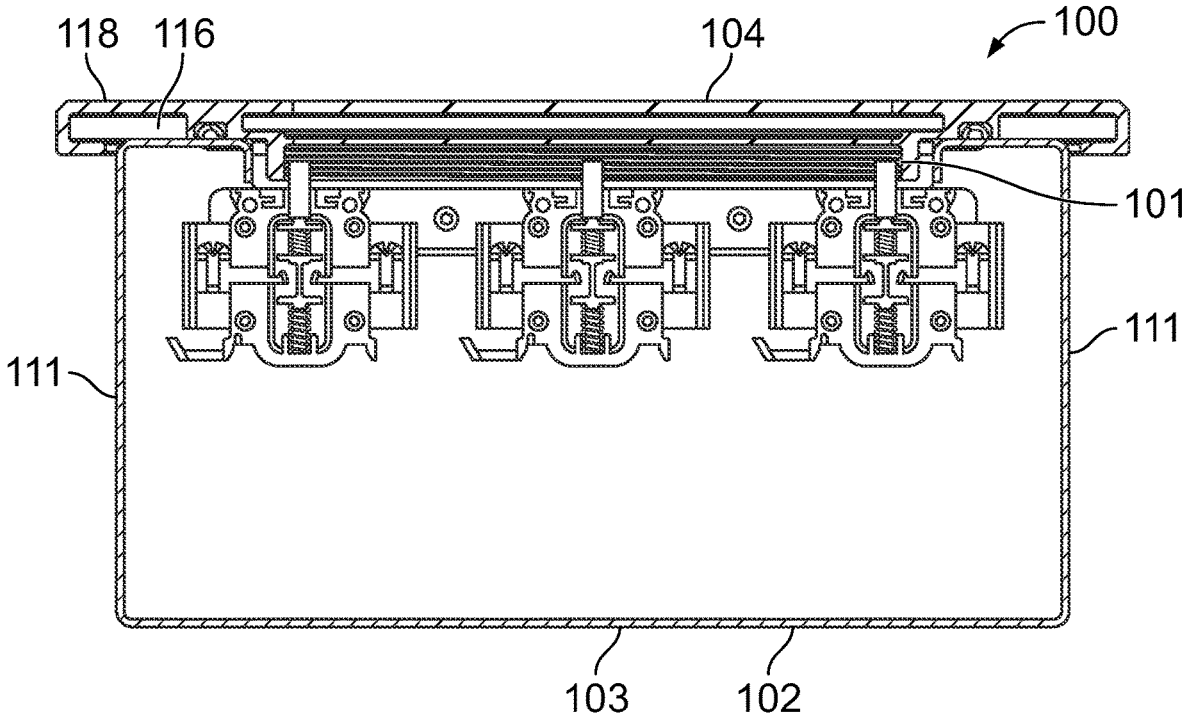
FIG. 6 illustrates a front sectional view of the enclosure in its closed operative configuration.
Figure 7A:
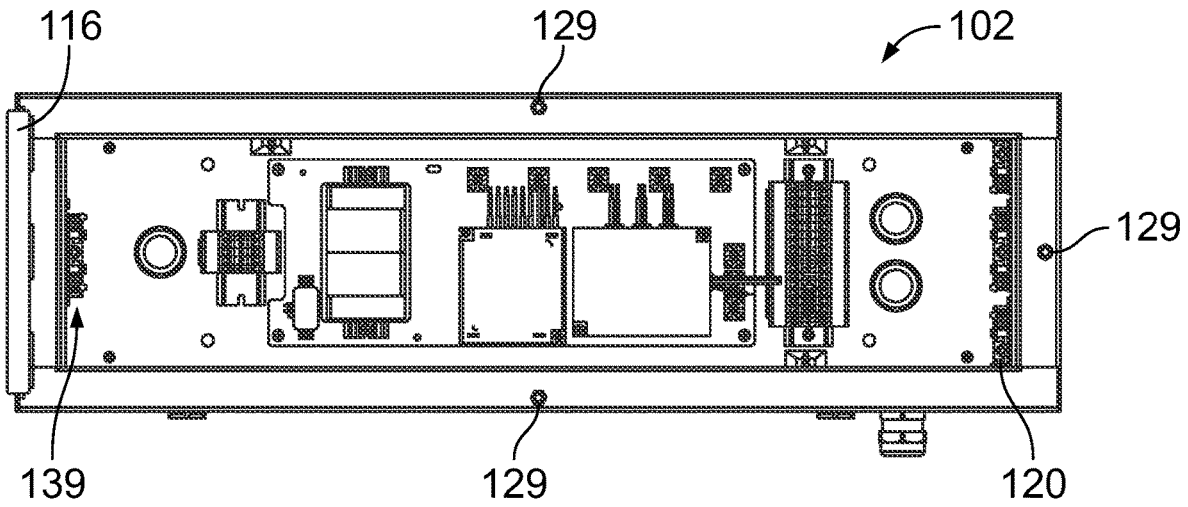
FIG. 7A illustrates a top view of a housing of the enclosure of FIG. 1.
Figure 7B:
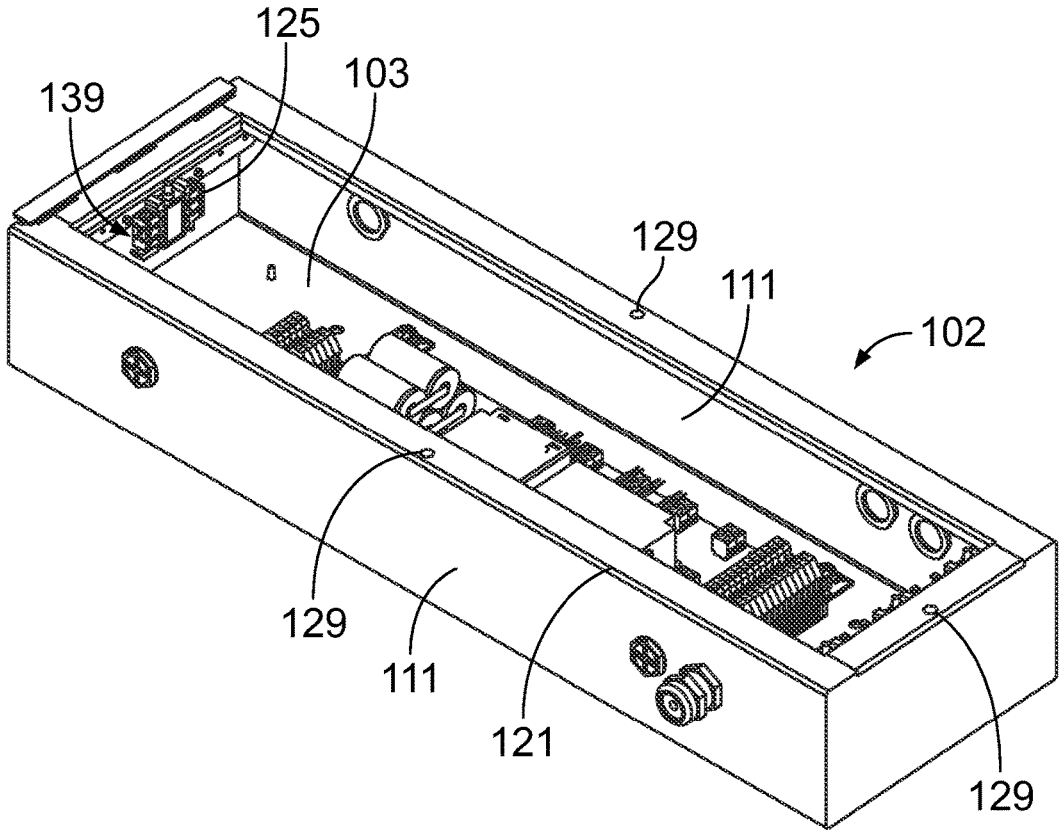
FIG. 7B illustrates an isometric view of the housing of FIG. 7A.

A recessed enclosure (100), of the present disclosure, for a light source (01) will now be described with reference to FIG. 1 through FIG. 7B.

The light source (01) is configured to be installed in an IP66 environment which mandates that no dust or moisture should permeate the enclosure (100). In an embodiment, the light source (01) is preferably an LED light source (01).

A recessed enclosure (100) comprises a housing (102), a light source (01) removably fitted in the housing, a lid frame (104), and three fasteners (114) for securely attaching the lid frame (104) to the housing (102). The housing (102) is defined by a body having a floor (103) and side walls (111) extending in an operative upward direction from the floor.

The housing (102) includes a mounting fixture formed on the floor. The mounting fixture is configured to allow the light fixture (01) to be fitted thereon. In an embodiment, the mounting fixture includes at least one pair of sockets for lockingly holding the light source (01) therein. The lid frame (104) is defined by a metal body having an inner surface (113), an outer surface (115), and an opening (106) configured on a center of the body. The opening (106) facilitates emission of light from the light source (01).

The lid frame (104) comprises a first groove (105) configured on the operative inner surface, along the periphery of the opening (106). The lid frame further comprises a first gasket (108) configured to be housed in the first groove (105). The first gasket (108) has a crevice (119) configured along the length of the first gasket (108). A transparent body (110) is nested in the crevice (119) for allowing light emitted by the light source (01) to pass through the opening (106). A pair of retainer clips (112) is provided along the longitudinal edges of the first groove (105). The retainer clips (112) are configured to compress and seal the first gasket (108) in the first groove (105) to ensure prevention of ingress of dust and moisture inside the enclosure (100) through the opening (106), thereby satisfying the conditions required for the light source to work in an IP66 environment.

In an embodiment, the housing (102) includes a layer secured to an operative central portion of the floor. The layer helps in dissipating heat generated by the light source (01), and thus prevents overheating and possibly fire breakouts in the enclosure (100). In a preferred embodiment, the fixture is formed on the layer.

In an embodiment, the body of the housing (102) includes rims (121) extending outwards from the sidewalls in a direction perpendicular to the sidewalls. In another embodiment, the housing (102) further includes a plurality of first apertures (129). Each of the first apertures is configured on each of the longitudinal rims and a first lateral rim of the housing (102). In another embodiment, the lid frame (104) includes rims (123) extending from the periphery of the body in a downward direction. The rims (123) of the lid frame (104) are configured to envelop the rims (121) of the housing (102) to close the enclosure (100). In another embodiment, the lid frame (104) includes a plurality of second apertures (131). Each of the second apertures is configured on each of the longitudinal rims and a first lateral rim of the lid frame (104), such that the second apertures are configured complementary to the first apertures. The first apertures and second apertures are configured to allow fasteners (114) to pass therethrough to facilitate attachment of the lid frame (104) with the housing (102).

Since only three fasteners (114) are used for the secure attachment of the lid frame (104) with the housing (102), the stress acting on the transparent body (110) or the lid frame body is considerably less. Further, the ingress of dust and moisture inside the enclosure (100) is completely prevented.

In an embodiment, the housing (102) includes a headboard (116) configured to extend from a second lateral rim of the housing (102). In another embodiment, the lid frame (104) includes a lip (118) extending from a second rim of the lid frame (104). The lip (118) is configured to be clamped on the headboard (116) to enable hingeable mounting of the lid frame (104) on the housing (102). The lid frame (104) is hingably mounted on the housing (102) with a predetermined relief angle (α) provided therebetween. In one embodiment, the predetermined relief angle ranges between 3° to 5°.

In a preferred embodiment, the lid frame (104) includes a second groove (128) configured on the operative inner surface of the lid frame (104). The second groove (128) is configured to complement the inner periphery defined by the sidewalls of the housing (102) in a closed configuration of the enclosure (100). In another embodiment, the lid frame (104) includes a second gasket (127) configured to be nested in the second groove (128). The second gasket (127) is configured to prevent ingress of dust and moisture inside the enclosure (100) through the rims of the housing (102) and the lid frame (104).

In an embodiment, the enclosure (100) includes a pressure switch (120) provided on the first lateral rim of the housing (102). The pressure switch (120) is connected to the light source (01). The pressure switch (120) is configured to be abutted by the second gasket (127) in a closed configuration of the enclosure (100). The pressure switch (120) is configured to be actuated on abutment of the second gasket (127) thereon to activate the light source (01). Conversely, if the pressure switch (120) is released say when the lid frame (10) is removed, the light source (01) is switched OFF. Thus, the pressure switch (120) ensures that actuation of the light source (01) is handles in a safe way.

In an embodiment, each retainer clip (112) has a flap (113) extending therefrom and angularly bent at a predetermined angle away from the horizontal axis. The retainer clips (112) are attached to the lid frame (104) such that when the lid frame (112) is mounted on the housing (102), the flaps (113) are bent down towards the light source (01) to facilitate reflection of light emitted by the light source (01) outwards. In an embodiment, the flaps (113) are angularly bent from the body of the retainer clip (112) by a predetermined angle that ranges from 140° to 160°. In another embodiment, the flaps (113) are angularly bent from the body of the retainer clip (112) by a predetermined angle of 150°. In an embodiment, the flap (113) has an arcuate configuration. In another embodiment, the flap (113) has a planar configuration. In an embodiment, it is preferential that the retainer clips (112) are coloured white in order to increase the reflection of light. In an exemplary embodiment, it has been observed that the flaps (113) of the retainer clips (112) increase the reflection of light by at least 10% as against enclosures (100) for light sources (01) without any retainer clip (112).

In an embodiment, the retainer clip (112) is a Z-clip.

In an embodiment, the housing (102) is manufactured from stainless steel. In another embodiment, the lid frame (104) is manufactured from aluminum coated with MS powder.

In one embodiment, the housing (102) includes a plurality of niches (139) configured on the side walls to nest a plurality of indicators (125) therein.

In a preferred embodiment, the first gasket (108) is a C-type gasket comprising a wall (108*a*) and flanges (108*b*) extending from either ends of the wall (108*a*) in a direction substantially perpendicular to the wall (108*a*) to define said crevice (109) between the operative free ends of the flanges (108*b*) for nesting the transparent body (110) therein. In one embodiment, the first gasket (108) is manufactured from silicon rubber, wherein the joints of the first gasket (108) are fused by vulcanizing the silicon rubber. In yet another embodiment, the flanges (108*b*) of the C-type gasket are separated with a predetermined distance ranging from 4.5 to 5 mm and at an angle ranging between 3° and 5°, preferably 4°.

In another embodiment, thickness of the first gasket (108) ranges between 2.2 mm and 2.8 mm. In a preferable embodiment, the thickness of the C-type gasket is 2.5 mm. In yet another embodiment, height of the first gasket (108) ranges between 8 mm and 11 mm. In a preferable embodiment, the height of the C-type gasket is 9.8 mm. In still another embodiment, the breadth of cross-section of the first gasket (108) ranges between 12 mm and 18 mm. In a preferable embodiment, the breadth of the cross-section of the C-type gasket is 15 mm. In still another embodiment, the edges of the first gasket (108) are filleted.

In an embodiment, the length of the lid frame (104) ranges between 665 mm and 660 mm. In another embodiment, the distance between the longitudinal edges of the opening (106) of the lid frame (104) ranges between 93 mm and 98 mm. In a preferable embodiment, the distance between the longitudinal edges of the opening (106) of the lid frame (104) is 95 mm.

In an embodiment, the distance between operative free edges of the flaps (113) in a mounted configuration of the retainer clips (112) ranges between 42 mm and 48 mm. In a preferable embodiment, the distance between the operative free edges of the flaps (113) in a mounted configuration of the retainer clips (112) is 45 mm.

In an exemplary embodiment, the enclosure (100), of the present disclosure, was tested by continuously spraying jets of water at a flow rate of 100 liters/min. After a time duration of 3 minutes, the spraying was stopped, zero moisture content was observed inside the enclosure (100). In another working embodiment, the enclosure (100) was tested by placing the enclosure (100) in a dust filled chamber at negative pressure of 20 millibar. After a time period of 8 hours, the enclosure (100) was taken out and, its exteriors were wiped thoroughly. When examined, it was observed that there was no dust content inside the enclosure (100).

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

Technical Advancements and Economic Significance

The present disclosure described herein above has several technical advantages including, but not limited to, the realization of a recessed enclosure for a light source, that:

- is used in an IP66 environment by protecting the light source from dust and moisture ingress; and
- ensures safety in operation of the light source with ease in installation.

The embodiments herein and the various features and advantageous details thereof are explained with reference to the non-limiting embodiments in the following description. Descriptions of well-known components and processing techniques are omitted so as to not unnecessarily obscure the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The use of the expression "at least" or "at least one" suggests the use of one or more elements or ingredients or quantities, as the use may be in the embodiment of the disclosure to achieve one or more of the desired objects or results.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. A recessed lamp comprising:

a housing defined by a body having a floor and side walls extending in an upward direction from said floor, a light source removably positioned in the housing;

a lid frame defined by a metal body having an inner surface, an outer surface, and an opening defined at a center of said body, said lid frame comprising:

a first groove formed on said inner surface, along the periphery of said opening, a first gasket configured to be received in said first groove, said first gasket having a crevice extending along the length of said first gasket, a transparent body nested in said crevice, and a pair of retainer clips provided along longitudinal edges of said first groove, said retainer clips configured to compress and seal said first gasket against said first groove to help prevent ingress of dust and moisture inside said enclosure through said opening;

wherein the transparent body is configured to receive light emitted by the light source and directed the received light to pass through said opening; and three fasteners for securely attaching said lid frame to said housing.

2. A recessed lamp as claimed in claim 1, further including a pressure switch provided on said first lateral rim of said housing, said pressure switch being connected to said light source, said pressure switch configured to be abutted by said second gasket in a closed configuration of said enclosure, said pressure switch further configured to be actuated on abutment of said second gasket thereon and activate the light source.

3. A recessed lamp as claimed in claim 1, wherein each retainer clip has a flap extending therefrom and angularly bent at a predetermined angle away from the horizontal axis, said flap configured to reflect light emitted by said light source in a closed configuration of said lid frame.

4. A recessed lamp as claimed in claim 1, wherein said housing comprises stainless steel.

5. A recessed lamp as claimed in claim 1, wherein said lid frame comprises aluminum coated with MS powder.

6. A recessed lamp as claimed in claim 1, wherein said housing includes a plurality of niches formed on said side walls to nest a plurality of indicators therein.

7. A recessed lamp as claimed in claim 1, wherein a length of said lid ranges between 660 mm and 665 mm.

8. A recessed lamp as claimed in claim 1, wherein a distance between the longitudinal edges of said opening of said lid frame ranges between 93 mm and 98 mm.

9. A recessed lamp as claimed in claim 1, wherein said housing includes a headboard extending from a second lateral rim of said housing.

10. A recessed lamp as claimed in claim 9, wherein said lid frame includes a lip extending from a second rim of said lid frame, said lip configured to be clamped on said headboard to enable hingeable mounting of said lid frame on said housing.

11. A recessed lamp as claimed in claim 1, wherein said lid frame includes a second groove formed on said inner surface of said lid frame, said second groove being configured to to be positioned over an inner periphery defined by said sidewalls of said housing in a closed configuration of said enclosure.

12. A recessed lamp as claimed in claim 11, wherein said lid frame includes a second gasket configured to be nested in said second groove to help prevent ingress of dust and moisture inside said enclosure through said rims of said housing and said lid frame.

13. A recessed lamp as claimed in claim 1, wherein said first gasket is a C-type gasket comprising a wall and flanges extending from either ends of said wall in a direction substantially perpendicular to the wall to define a crevice between the operative free ends of said flanges for nesting said transparent body therein.

14. A recessed lamp as claimed in claim 13, wherein said first gasket comprises silicone rubber.

15. A recessed lamp as claimed in claim 13, wherein a thickness of said first gasket ranges between 2.2 mm and 2.8 mm.

16. A recessed lamp as claimed in claim 13, wherein a height of said first gasket ranges between 8 mm and 11 mm.

17. A recessed lamp as claimed in claim 13, wherein a breadth of cross-section of said first gasket ranges between 12 mm and 18 mm.

18. A recessed lamp as claimed in claim 1, wherein said body of said housing includes rims extending outwardly from said sidewalls in a direction perpendicular to said sidewalls.

19. A recessed lamp as claimed in claim 18, wherein said housing includes a plurality of first apertures, each of said first apertures is formed on each of the longitudinal rims and a first lateral rim of said housing.

20. A recessed lamp as claimed in claim 18, wherein said lid frame includes rims extending from the periphery of said body in a downward direction, said rims extending from the lid frame configured to envelop said rims of said housing to close said enclosure.

21. A recessed lamp as claimed in claim 20, wherein said lid frame includes a plurality of second apertures, each of said second apertures is formed on each of the longitudinal rims and a first lateral rim of said lid frame complementary to said first apertures.

22. A recessed lamp as claimed in claim 21, wherein said first apertures and second apertures are configured to allow fasteners to pass therethrough to facilitate attachment of said lid frame with said housing.

* * * * *